US006056413A

United States Patent [19]

Urso

[11] Patent Number: 6,056,413

[45] Date of Patent: May 2, 2000

[54] CAP LAMP

[76] Inventor: Charles L. Urso, 54 Marivista Ave., P.O. Box 1136, Waltham, Mass. 02254

[21] Appl. No.: 08/999,490

[22] Filed: Dec. 29, 1997

[51] Int. Cl.[7] ..... F21L 15/14

[52] U.S. Cl. ..... 362/106; 362/187; 362/283; 362/322

[58] Field of Search ..... 362/103, 105, 362/106, 157, 187, 282, 283, 322, 321; 2/422

[56] References Cited

U.S. PATENT DOCUMENTS

| | | | |
|---|---|---|---|
| 1,572,210 | 2/1926 | Kolibas | 362/106 |
| 1,744,777 | 1/1930 | Lundgren | 362/106 |
| 2,203,028 | 6/1940 | Parrillo | 362/106 |
| 2,971,082 | 2/1961 | Frank | 362/106 |
| 3,032,647 | 5/1962 | Wansky et al. | 362/106 |
| 3,133,705 | 5/1964 | Eickelman | 362/106 |
| 4,298,913 | 11/1981 | Lozar | 362/103 |
| 4,406,040 | 9/1983 | Cannone | 362/106 |
| 4,827,384 | 5/1989 | Von Schlemmer | 362/106 |
| 4,991,068 | 2/1991 | Mickey | 362/106 |
| 5,463,538 | 10/1995 | Womack | 362/106 |
| 5,541,816 | 7/1996 | Miserendino | 362/106 |
| 5,667,292 | 9/1997 | Sabalvaro | 362/106 |
| 5,741,060 | 4/1998 | Johnson | 362/106 |

*Primary Examiner*—Alan Cariaso

[57] ABSTRACT

A cap lamp (5) includes a baseball-style cap (6) having a visor (16) with an underside substantially defined by a concave visor reflector (22). A light source (24) is pivotally supported under the visor for directing light at selectively adjustable angles. A first hood (36A) partially surrounds the light source for shading a user's face from light coming directly from the light source. The hood has an upward lateral opening (39) to emit light toward the visor reflector for flooding the immediate vicinity of the user with visor reflected light. A frontal opening (42) of the hood is provided for emitting a light beam forward of the visor. A concave hood reflector (40), within the hood, is provided for increasing the light directed to and reflected by the visor reflector. A second hood (36B) is supported to rotate about the first hood between open and closed positions for selectively inhibiting light communication with the visor reflector. An arcuate strip (49) is hidden within the cap to support a battery holder (54) which is electrically connected to the light source for energizing the same.

20 Claims, 1 Drawing Sheet

CAP LAMP

FIELD OF INVENTION

This invention relates to portable electric lamps and more particularly to portable lamps for being worn on a user's head to free his or her hands.

BACKGROUND

Some of the advantages of an illumination device worn on a user's head are well-known. Surgeons, for example, might wear a lamp on their heads to focus light on a patient while leaving their hands free to perform surgery. Surgical head lamps are connected to a power source by an electrical cord. Application of such lamps is very specialized and portability is limited.

Hard hats may have lamps mounted on them for exploring caves, working in mines, or dealing with night-time utility emergencies. They are not practical for general use, however, because their weight and lack of head ventilation makes them uncomfortable to wear.

A head lamp, with growing presents in the marketplace, has head straps for mounting the lamp on the user's forehead. The lamp projects a light beam ahead of the user. Though the device leaves the user's hands free, the projected light is totally slaved to the direction faced by the user's head. The user must move his head up or down to vertically adjust the projected light. Further, the immediate vicinity of the user is not illuminated when the light beam is directed ahead of the user. Hence, if the user directs the light beam ahead of him to see where he is going, he might not be able to see the ground under him to avoid tripping in the dark. Still another shortcoming of conventional head lamps is that they don't illuminate the user. Illumination of the user can be important for being seen by oncoming drivers and can be life-saving when jogging or during roadside emergencies. Still another problem is that the weight and bulk of a conventional head lamp, including the batteries, are on the user's forehead and are therefore unbalanced and unsightly.

OBJECTS AND ADVANTAGES OF THE INVENTION

The present invention is provided to overcome the shortcomings and limitations of conventional head lamps. Accordingly, objects and advantages of the present invention are:

(a) to provide a lamp incorporated in a baseball-style soft cap such that the combination is light in weight, low in cost, comfortable to wear, convenient to put on and take off, and is aesthetically pleasing.

(b) to provide a head lamp that projects a light beam that can be adjusted vertically relative to the user's head.

(c) to provide a head lamp capable of directing a light beam ahead of the user with a selective option of simultaneously illuminating the immediate vicinity of the user for needs such tool handling and use of peripheral vision.

(d) to provide a head lamp that can be worn frontward or backward to illuminate the user for the safety of being seen by oncoming drivers when jogging at night or during roadside emergencies.

Further objects and advantages will become apparent from consideration of the ensuing description and drawings.

SUMMARY

The present invention comprises a visor having an underside substantially defined by a concave visor reflector or concave mirror for reflecting light. The visor is combined with a soft cap shell to form a baseball-style cap. A light source is pivotally supported at the visor underside for directing light source light at selectively adjustable angles relative to the visor. A hood is mounted under the light source, partially surrounding the same, thereby shading a user's face from light coming directly from the light source. The hood has an upward lateral opening or window which is open toward the visor reflector for emitting light source light toward the visor reflector for flooding the immediate vicinity of the user with visor reflected light. A frontal opening or window of the hood is positioned transverse to the lateral opening for emitting direct light source light forward of the visor. A concave mirror or hood reflector is located inside the hood, partially surrounding the light source. The hood reflector is positioned facing the visor reflector for increasing the light directed to and reflected by the visor reflector. A second hood is supported to rotate about the first hood between an open position conforming with the first hood and a closed position substantially opposite the first hood thereby inhibiting light communication with the visor reflector. A stiff arcuate strip is attached inside the cap shell to form an arch hidden therein for spanning over the user's head. A battery holder is attached to a top portion of the arch and electrically connected to the light source so that replaceable batteries can be supported by the arch for energizing the light source.

BRIEF DESCRIPTION OF THE DRAWINGS

The accompanying drawings in combination with the description herewith, illustrate features and advantages of the invention. Like reference numerals in different views refer to the same parts. The drawings are intended to illustrate principles of the invention and are not necessarily to scale.

DESCRIPTION

Figure 3:
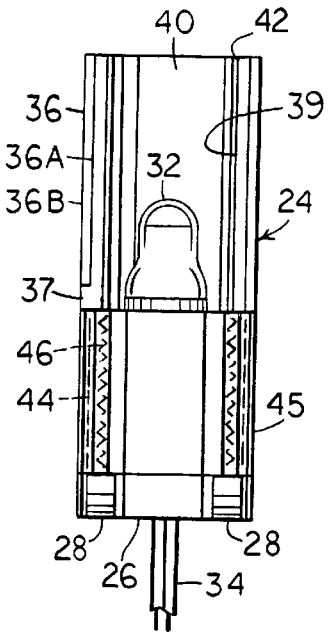
FIG. 3 is an enlarged top view of an electric light of the cap lamp of FIG. 1 wherein a hinge leaf is removed.
Figure 1:
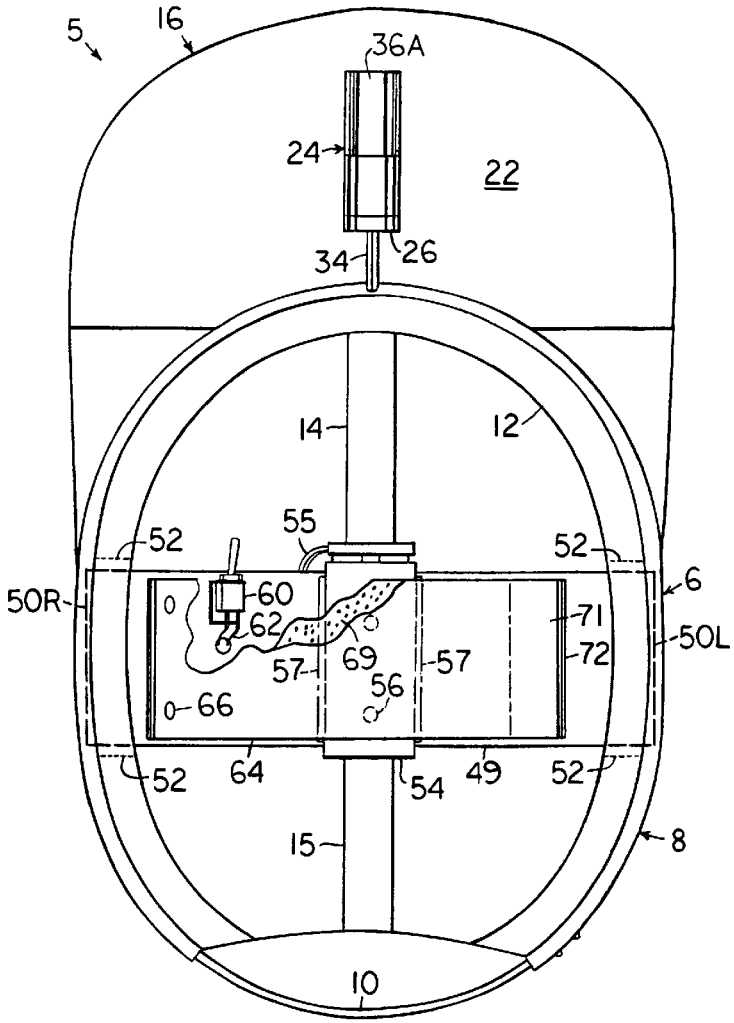
FIG. 1 is a bottom view of the cap lamp wherein a portion of a fabric strip is cut away to show other components.
Figure 2:
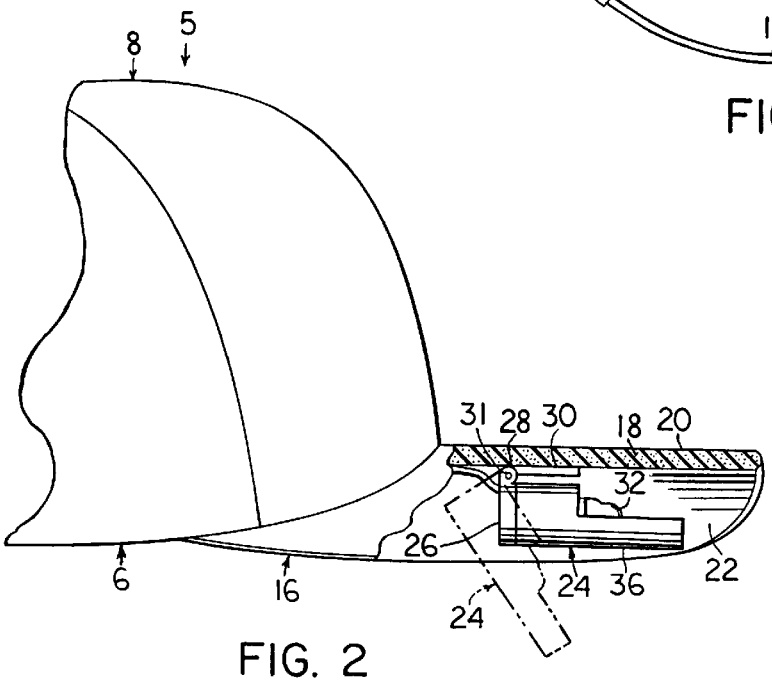
FIG. 2 is a fragmental side view of the cap lamp of FIG. 1 shown partly in section.

FIGS. 1–4 show a preferred embodiment of a cap lamp 5 embodying principles of the subject invention. Included is a baseball-style soft cap 6 having a shell 8 made of soft supple material and substantially conventional in construction. Cap 6 includes an adjustable strap 10 (FIG. 1) for adjusting the cap size, a sweatband 12, and seam strips 14 and 15, all of which are conventional. As is common practice, a bottom edge of sweatband 12 is attached to a circumferential edge of shell 8.

A visor 16 is conventionally attached to a frontal edge of shell 8 wherein visor 16 projects therefrom in customary fashion for a baseball-style cap. Visor 16 has a plastic foam core 18 (FIG. 2) which is coated on a convex topside with a plastic skin 20. An underside of visor 16 is substantially defined by a concave reflector 22 which is cemented to the bottom of visor core 18. Reflector 22 is a concave mirror made of plastic with a reflective aluminum coating.

Attached to the underside of visor 16 is an electric light 24 which points forward of visor 16. Included in light 24 is a plastic socket base 26 having hinge lugs 28 molded integrally therewith. A hinge leaf 30, cemented to reflector 22, is pivotally connected to lugs 28 by a hinge pin 31 which passes through aligned pin holes through lugs 28 and leaf 30. Thus, light 24 is pivotally movable, along a vertical plane, between the solid and phantom depictions in FIG. 2. Hence, light 24 can direct light at selectively adjustable angles relative to visor 16.

Socket base 26 includes a conventional bulb socket chamber (not shown) containing a conventional threaded metal bulb socket (not shown). A prefocused electric light bulb 32 is threadedly received in the bulb socket of socket base 26. Bulb 32 can be energized through a two-element wire 34 (FIG. 1) passing though an aperture in base 26 and electrically connected to the bulb socket.

Mounted around bulb 32 is a hollow hood 36 (FIG. 3) which is comprised of a first or inner hood 36A and a second or outer hood 36B fitted to rotate about hood 36A. Hood 36A is mounted under and partially surrounding bulb 32, thereby shading the user's face from light coming directly from bulb 32. Hood 36A is semi-cylindrical and has a U-shaped upward lateral window or opening 39 which is open upward toward visor reflector 22. Opening 39 serves primarily for emitting light from bulb 32 upward toward reflector 22 thereby flooding the immediate vicinity of the user with visor reflected light. The prefocused bulb 32 emits a frontal beam, but also emits light laterally toward reflector 22.

A reflective aluminum coat lines an interior surface of hood 36A to form a concave hood mirror or reflector 40 which is positioned partially surrounding bulb 32 and facing visor reflector 22. A primary purpose of reflector 40 is for increasing the light directed to and reflected by visor reflector 22.

Hood 36A further includes a U-shaped second window or frontal opening 42, positioned perpendicular or transverse to opening 39, for emitting a direct beam of light from bulb 32 forward of the visor. A rear end portion of hood 36A forms a hollow sleeve 44 having an interior surface threadedly mated to base 26 which has an exterior surface thread 46 shown in phantom image.

Hood 36B is substantially the same in structure as hood 36A, but is larger in diameter and its sleeve 45 has no internal thread. An inner surface of hood 36B is coated with a reflector (not shown) similar to reflector 40. Hood 36B is rotatable about an outer surface of hood 36A for rotating 180 degrees between an open position (FIGS. 2 and 3) conforming with hood 36A and a closed position (FIG. 1) such that the semi-cylindrical portions of both hoods are opposite each other. A stop 37 (FIG. 3) extending radially from an edge of hood 36A fits loosely in a notch in an edge of hood 36B. Stop 37 serves to limit rotation to 180 degrees so that the open and closed positions are not exceeded. Stop 37 also prevents hood 36B from sliding forward, wherein base 26 prevents rearward slide of hood 36B. In the closed position, hood 36 forms a substantially hollow cylinder defining a round frontal opening, wherein lateral opening 39 is covered or closed. Thus, in the closed position, light communication with visor reflector 22 is inhibited or prevented while the opposing hood reflectors increase light beamed forward of visor 16 from the frontal opening of hood 36. Hood 36B, therefore, enables a user to turn off visor reflected light when only light beamed forward of the user is needed. Light 24 can be pivotally adjusted up or down, relative to visor 16, in either of the open or closed positions.

To replace bulb 32, hood 36 is unscrewed from base 26 and then bulb 32 is unscrewed for replacement. Reassembly is done in reverse order.

Within shell 8 across the middle (FIG. 1) is a stiff arcuate plastic strip 49 forming an arch therein which spans over the user's head. Lower end portions 50L and 50R of strip 49 are positioned at diametrically opposite sides of shell 8 in pockets formed by stitching sweatband 12 to the fabric of shell 8 with vertical stitches 52. The bottoms of the pockets thus formed are closed because the lower edge of sweatband 12 is conventionally attached to a circumferential edge of shell 8. Thus, strip 49 is secured and lines the inside of shell 8, thereby giving a nicely rounded appearance to the top of cap 6.

A battery holder 54, with wire leads 55, is attached with rivets 56, to an underside of a top portion of the arch formed by strip 49. Replaceable batteries 57, in holder 54, are supported by the arch for energizing bulb 32.

Figure 4:
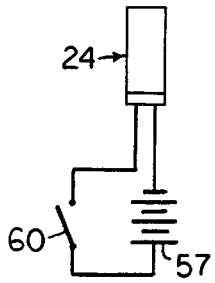
FIG. 4 is a diagram showing the electric circuit of the cap lamp of FIG. 1.

The two-element wire 34 passes behind sweatband 12, and under seam strip 14, to emerge above and behind strip 49 where the wire is hidden and not shown. A conventional toggle switch 60, having wire leads 62 passing through an aperture in strip 49, is electrically connected to light 24 and batteries 57 by way of wires 62, 34 and 55, all mostly hidden behind strip 49. The simple circuit of FIG. 4 shows the connections which allow light 24 to be turned ON or OFF by switch 60.

A soft fabric strip 64 has an end portion fixed to strip 49 with rivets 66. Strip 64 is cushion-backed with a foam cushion 69 covering battery holder 54 for the comfort of the user. An opposite end portion of strip 64 is attached to a nylon pile fastener pad 71. A adhesive-backed hook fastener pad 72, mated to pad 71, is attached to strip 49. Pads 71, 72 may be Velcro (registered trademark) or other brand of mated fastening material that detachably interlocks when pressed together to hold strip 64 in place.

Uses and Applications

The present invention has unlimited uses and applications. A few of them are:

(a) For jogging and cross-country skiing at night

The adjustable light beam enables a jogger or skier to see ahead of him. The visor reflected light makes the jogger visible to oncoming car drivers and makes the cross-country skier visible to snowmobile drivers. When needed just for illuminating the user, the cap lamp can be worn frontward or backward.

(b) For dealing with nighttime roadside emergencies

When changing a flat tire or replacing auto fluids, the light beam focuses on the work area; the visor reflected light illuminates the user to avoid being struck by other cars.

(c) For country living

In small towns and country where there is less outdoor lighting, the cap lamp can is a valuable hands-free lighting aid at night when carrying wood from the wood shed, tending to livestock, etc.

(d) As a visual aid for the elderly

Elderly people with diminished vision can be aided by the cap lamp for reading mail, to avoid tripping and falling, and for being safely illuminated when crossing a street after dark.

(e) For electrical and plumbing repairs

The cap lamp is ideal for close-up illumination of the dark cavities inside walls and ceilings when doing electrical and plumbing repairs. Both hands are free to do the work.

(f) For night or pre-dawn fishing

Wearing the cap lamp, a wading fisherman can bait and operate fishing gear under the visor reflected light and see his outstretched line with the beamed light.

While the above description contains many specificities, these should not be construed as limitations on the scope of the invention, but rather as an exemplification of a preferred embodiment. Those skilled in the art will envision other possible variations that are within its scope. For example, the light hoods and/or their reflectors may be funnel or semi-funnel shaped, flaring widest at the frontal end. High-performance gas bulbs such as halogen or xenon may be used in place of the bulb shown. An alternative cap style, hard or soft may be used, such as an insulated cold weather cap having a visor and ear flaps. A capless visor supporting a light having a self-contained miniature battery could be worn without a cap shell and may be called a visor lamp. Or, a larger battery holder could be supported clipped to a pocket or belt of the user and electrically connected to the visor light by a cord. Accordingly, the scope of the invention should be determined not by the embodiment illustrated, but by the appended claims and their legal equivalents.

What is claimed is:

1. A lamp for being worn on a user's head comprising:

a visor having an underside at least partially defined by a concave light reflecting surface which forms a visor reflector;

visor support means for holding the visor on the user's head;

a light source and light source support means for supporting the light source under the visor;

flood light means for directing light from the light source toward the visor reflector for flooding the immediate vicinity of the user with visor reflected light; and spot light means for directing focused light from the light source which bypasses the visor reflector.

2. The lamp as defined in claim 1, further comprising means for operating the spot light means independently of the flood light means.

3. The lamp as defined in claim 1, wherein the flood light means includes a concave light reflector partially surrounding the light source and having a reflective surface facing the visor reflector.

4. The lamp as defined in claim 3, further comprising means for movably supporting one of the reflectors for being movable relative to the other reflector.

5. The lamp as defined in claim 1, wherein the light source support means includes means for movably supporting the light source for being movable relative to the visor reflector.

6. A lamp for being worn on a user's head comprising:

a visor having an underside at least partially defined by a concave light reflecting surface which forms a visor reflector;

visor support means for holding the visor on the user's head;

a light source and light source support means for supporting the light source under the visor; and a first hood mounted under the light source and partially surrounding the light source thereby shading the user's face from light coming directly from the light source, the hood having a window toward the visor reflector for transmitting light from the light source to the visor reflector.

7. The lamp as defined in claim 6, further comprising a concave hood reflector located inside the first hood and partially surrounding the light source, the hood reflector being positioned facing the visor reflector for increasing light directed to and reflected by the visor reflector.

8. The lamp as defined in claim 7, further comprising means for movably supporting the hood reflector for being movable to selective angles relative to the visor reflector.

9. The lamp as defined in claim 6, further comprising a second hood supported to rotate about the first hood between open and closed positions, the second hood in the open position substantially conforms with the first hood to allow light transmission from the light source to the visor reflector, the second hood in the closed position being substantially opposite the first hood thereby inhibiting said light transmission to the visor reflector.

10. The lamp as defined in claim 9, further comprising a stop extending radially from one of the hoods to engage the other hood when in at least one of said positions thereby preventing the second hood from exceeding the position.

11. The lamp as defined in claim 9, further comprising a light reflector lining the inside of each hood.

12. The lamp as defined in claim 6, further comprising means for movably supporting the light source for being movable relative to the visor reflector.

13. The lamp as defined in claim 6, further comprising the hood having a second window for emitting a beam of light, from the light source, that bypasses the visor reflector.

14. A cap lamp for being worn on a user's head comprising:

a soft cap having a soft cap shell connected to a visor;

a light source mounted on a frontal portion of the cap;

a stiff arcuate strip, within the cap shell, forming an upstanding arch for spanning over the user's head; and attaching means for attaching an electric power source to the strip for energizing the light source wherein the power source weight is broadly distributed by the strip.

15. The lamp as defined in claim 14, further comprising the cap having a sweatband inside the cap shell, the sweatband being attached to a circumferential edge portion of the shell wherein the arch includes lower end portions held between the sweatband and the cap shell.

16. The lamp as defined in claim 14, further comprising a head cushion detachably connected under the arch by means of a hook-and-loop fastener pad.

17. The lamp as defined in claim 14, further comprising the visor having a concave visor reflector on an underside thereof, and means for directing light from the light source in selective directions which include a direction toward the reflector and a direction bypassing the reflector wherein at least one of the light directions is selectable exclusive of the other.

18. The cap lamp as defined in claim 14, wherein the stiff strip includes lower end portions attached at diametrically opposite sides of the shell, respectively, such that the strip crosses the middle of the shell.

19. The cap lamp as defined in claim 14, wherein the attaching means is positioned at a top portion of the strip.

20. The cap lamp as defined in claim 14, wherein the cap is baseball style having a dome-shaped shell and the stiff strip lines the inside of the shell from the top of the dome to diametrically opposite sides thereof.

* * * * *